US006138585A

United States Patent [19]

Racine

[11] Patent Number: 6,138,585

[45] Date of Patent: Oct. 31, 2000

[54] CLINKER GRINDER SEAL IN COAL-BURNING UTILITY ELECTRICAL POWER GENERATION PLANT

[75] Inventor: David G. Racine, Ishpeming, Mich.

[73] Assignee: Wisconsin Electric Power Company, Milwaukee, Wis.

[21] Appl. No.: 09/315,914

[22] Filed: May 20, 1999

[51] Int. Cl.[7] ..... F23J 1/02

[52] U.S. Cl. ..... 110/169; 110/233; 277/572; 277/540; 432/242; 241/216

[58] Field of Search ..... 110/165 R, 167, 110/169, 233, 106, 108; 241/243, 216; 277/510, 555, 522, 572, 540, 436; 432/242, 244

[56] References Cited

U.S. PATENT DOCUMENTS

| | | | |
|---|---|---|---|
| 1,807,555 | 5/1931 | Ruggles | 277/41 |
| 2,037,990 | 4/1936 | Martin | 110/165 |
| 2,634,145 | 4/1953 | Monahon | 288/2 |
| 2,693,775 | 11/1954 | Berry | 110/165 |
| 3,472,522 | 10/1969 | Winfrey | 277/41 |
| 3,521,890 | 7/1970 | Holmes et al. | 277/35 |
| 3,975,026 | 8/1976 | Boyle et al. | 277/4 |
| 3,976,252 | 8/1976 | Perdue | 241/46.02 |
| 4,082,232 | 4/1978 | Brewer | 241/236 |
| 4,397,248 | 8/1983 | Mehta et al. | 110/263 |
| 4,419,941 | 12/1983 | Santalla | 110/232 |
| 4,773,600 | 9/1988 | Metski | 241/101.7 |
| 5,243,922 | 9/1993 | Rehmat et al. | 110/233 |
| 5,379,480 | 1/1995 | Lo | 15/246 |
| 5,492,279 | 2/1996 | Strich | 241/121 |
| 5,513,556 | 5/1996 | Schaefer | 92/168 |

OTHER PUBLICATIONS

"Chesterton 14K Restriction Bushing", HPD Doc No. hp14Kps.pdf, A.W. Chesterton Co., Middlesex Industrial Park, 225 Fallon Road, Stoneham, Massachusetts 02180–9101 USA, Feb. 1997, Oct. 1996.

*Primary Examiner*—Pamela Wilson
*Assistant Examiner*—Ken Rinehart
*Attorney, Agent, or Firm*—Andrus, Sceales, Starke & Sawall, LLP

[57] ABSTRACT

A coal-burning utility electrical power generation plant includes a mill pulverizing coal and supplying same to a boiler for combustion. The boiler has a bottom ash hopper for receiving combustion products including clinkers, and a clinker grinder for grinding the clinkers. The clinker grinder includes a rotary drum in a grinding chamber and having grinding teeth and driven by a rotary shaft extending through a stuffing box assembly. The stuffing box assembly has a flushing fitting for supplying flushing fluid thereto and along the shaft and into the grinding chamber. A seal permits flushing fluid flow from the flushing fitting into the grinding chamber, and blocks reverse flow. Long life is provided without a grease fitting, and leakage is substantially reduced.

9 Claims, 4 Drawing Sheets

FIG. 2
PRIOR ART
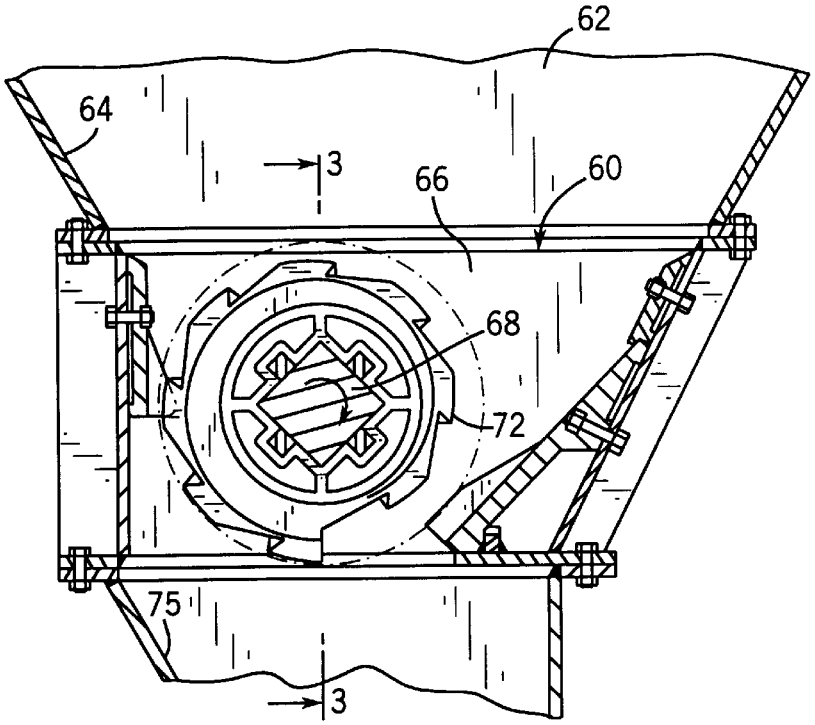
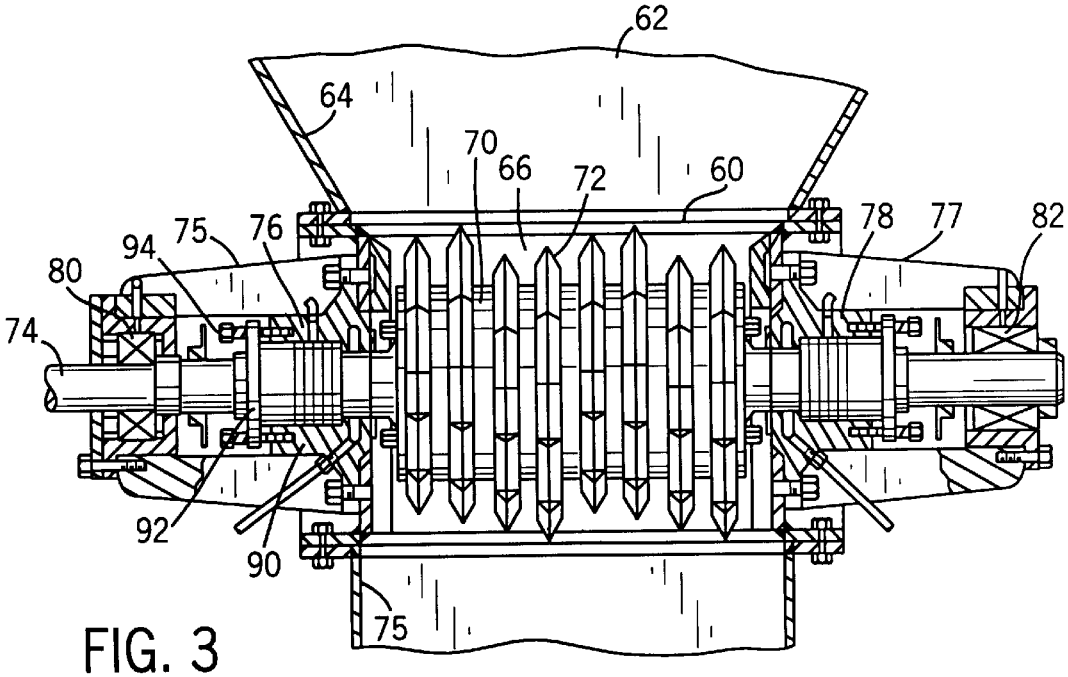
FIG. 3
PRIOR ART

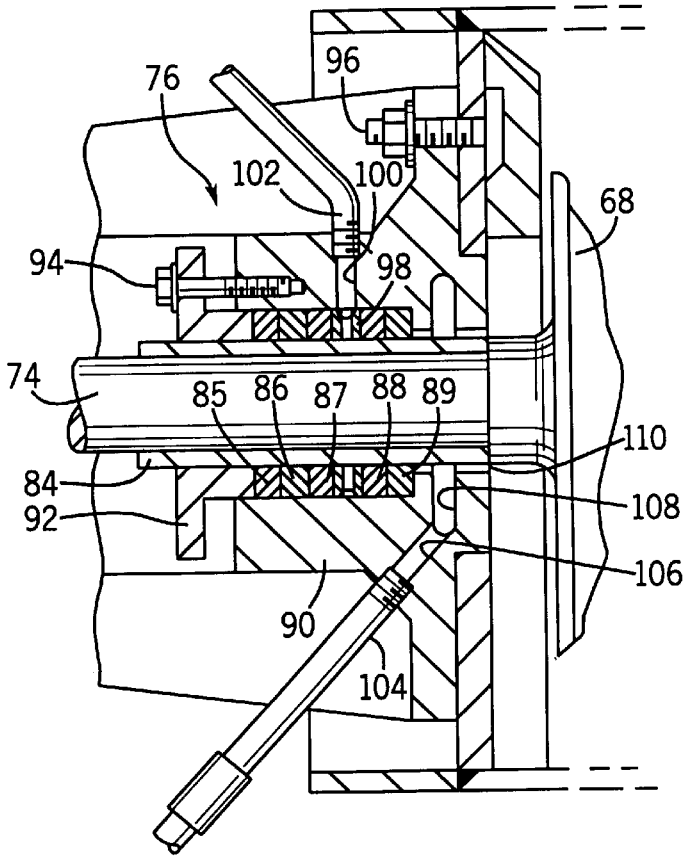
FIG. 4
PRIOR ART
FIG. 5
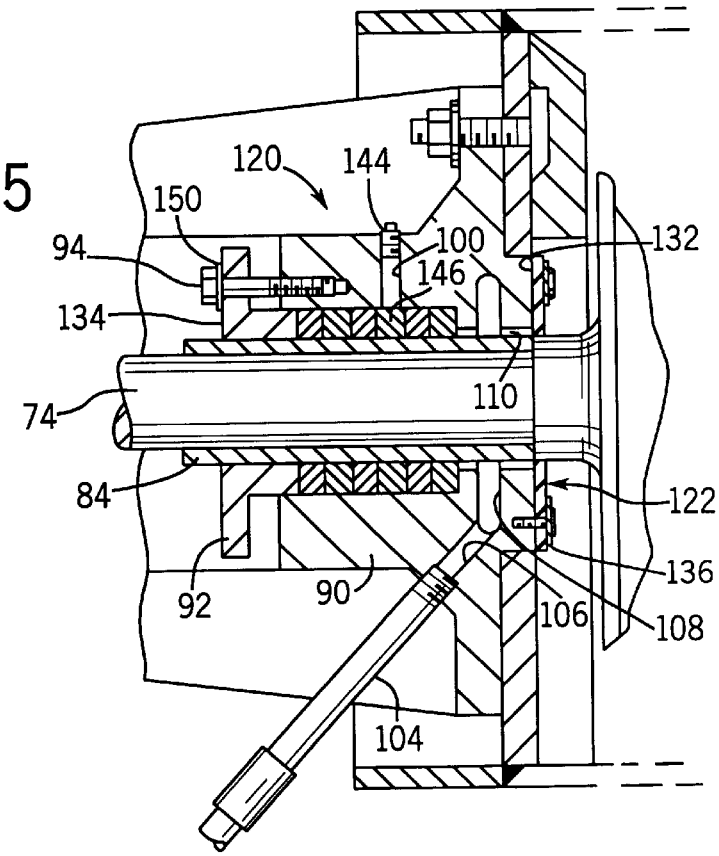

FIG. 6
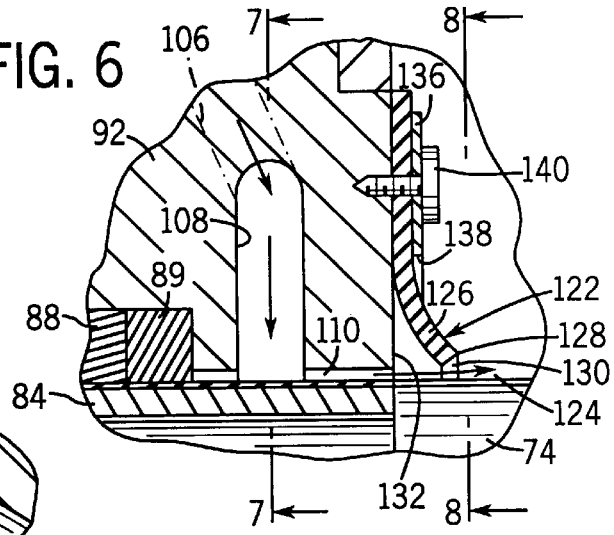
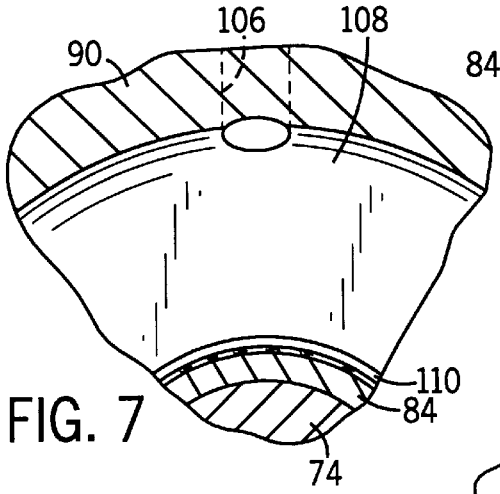
FIG. 7
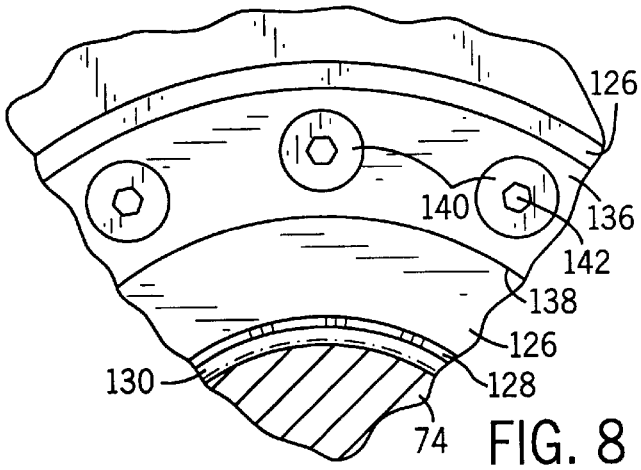
FIG. 8
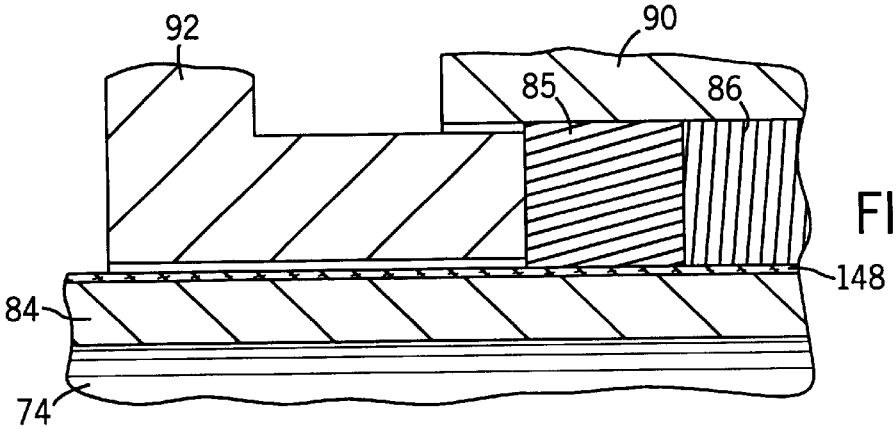
FIG. 9

CLINKER GRINDER SEAL IN COAL-BURNING UTILITY ELECTRICAL POWER GENERATION PLANT

BACKGROUND AND SUMMARY

The invention relates to coal-burning utility electrical power generation plants, and more particularly to a clinker grinder seal and valve.

In a coal-burning utility electrical power generation plant, coal is pulverized in a ball tube mill and supplied as coal dust to a burner for ignition and combustion with incoming combustion air. After ignition and burning, the spent coal dust fuses as hardened chunks, called clinkers, which are collected and ground at a lower clinker grinder, for discharge and disposal. The clinker grinder includes a grinding chamber with a plurality of grinding teeth on plates mounted to a rotary shaft supported for rotation by external bearings on each side of the grinding chamber. Between the grinding chamber and each bearing is a seal cage having a packing or stuffing box through which the rotary shaft extends. The seal cage and packing box seals the interior of the grinding chamber, to minimize escape of coal dust or particles.

The present invention provides improvements in the clinker grinder seal cage. In one aspect, a one-way seal is provided permitting flushing fluid flow from a flushing fitting into the grinding chamber, and blocking reverse flow. In another aspect, improvements in the stuffing box provide longer life.

BRIEF DESCRIPTION OF THE DRAWINGS

FIG. 2 is a view of the clinker grinder of the plant of FIG. 1 at line 2—2.

FIG. 3 is a sectional view taken along line 3—3 of FIG. 2.

FIG. 4 is a sectional view of a portion of the structure of FIG. 3 and shows the prior art.

FIG. 5 is a view like FIG. 4, but shows the present invention.

FIG. 6 is an enlarged view of a portion of the structure of FIG. 5.

FIG. 7 is a sectional view taken along line 7—7 of FIG. 6.

FIG. 8 is a sectional view taken along line 8—8 of FIG. 6

FIG. 9 is an enlarged view of a portion of the structure of FIG. 5.

DETAILED DESCRIPTION

Figure 1:
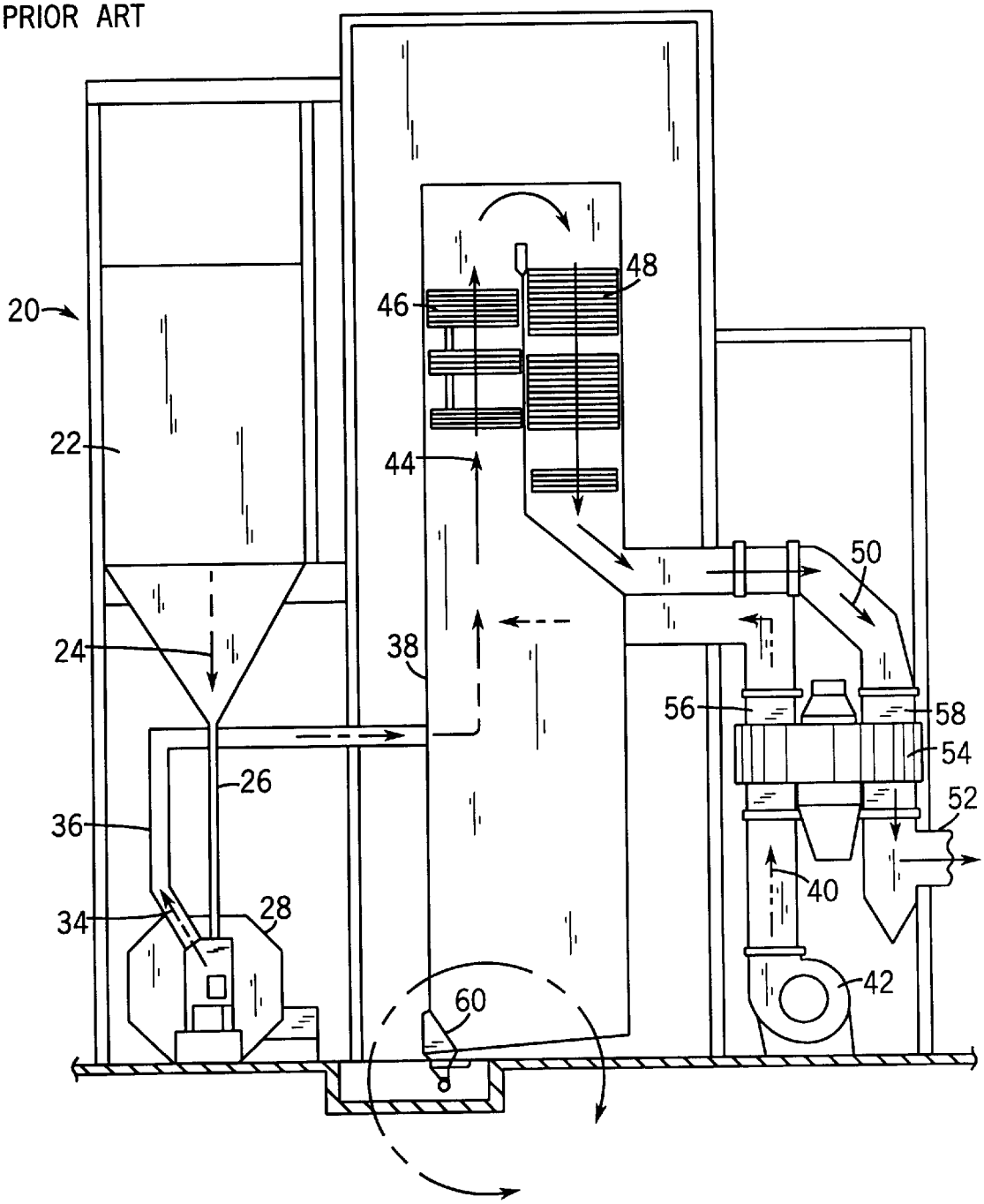
FIG. 1 PRIOR ART
FIG. 1 is a schematic illustration of a portion of a coal-burning utility electrical power generation plant.

FIG. 1 shows a portion of a coal-burning utility electrical power generation plant 20. Coal is loaded into hopper 22 and gravity fed as shown at arrow 24 to inlet duct 26 of ball tube mill 28. The mill includes a rotary drum with a charge or plurality of balls therein which pulverize the coal as the drum rotates. The pulverized coal dust is discharged as shown at arrow 34 to outlet duct 36 for introduction to the burner of boiler 38. Incoming combustion air is supplied as shown at arrow 40 from fan 42. The heat of combustion of the air and coal dust is supplied as shown at arrow 44 through a plurality of heat exchangers 46, 48, to generate steam to in turn drive electrical power generating turbines, as is standard. After giving up heat for the noted steam generation, exhaust including fly ash flows as shown at arrow 50 to exhaust outlet 52. An air preheater duct 54 is connected between combustion air inlet duct 56 and exhaust outlet duct 58 for transferring heat from the exhaust flow at 50 to the incoming combustion air flow at 40 to pre-heat the latter. The spent coal dust, after ignition and burning, fuses as hardened chunks called bottom ash clinkers, and are collected and ground at lower clinker grinder 60 for discharge and disposal.

FIGS. 2 and 3 show bottom ash hopper 62 at the bottom of boiler 38 having tapered frusto-conical side walls such as 64 funneling the clinkers to grinding chamber 66 in clinker grinder 60, for grinding the clinkers. The clinker grinder includes a rotary drum 68 having a plurality of plates bolted thereto and having grinding teeth 72 and driven by a rotary shaft 74 which in turn is driven by a motor (not shown). The ground clinkers are discharged at discharge chute 75 for collection and disposal via a hydraulic conveying system (not shown). Shaft 74 is supported for rotation by external bearings 80 and 82 on each side of the grinding chamber. Between the grinding chamber and each bearing is a respective seal cage 75 and 77 having a respective packing or stuffing box assembly 76 and 78 though which shaft 74 extends. The seal cage and packing box seals the interior of the grinding chamber, to minimize escape of coal dust or particles. The structure described thus far is standard and known in the prior art. The present invention relates to improvements in the stuffing box and clinker grinder housing.

FIG. 4 shows stuffing box assembly 76 of FIG. 3 in greater detail, which stuffing box arrangement is known in the prior art. Rotary shaft 74 has a sleeve 84 fixed thereto and journaled in annular packing rings 85,86,87,88,89 retained in stuffing box hub 90 by packing gland 92 secured to the hub by bolts such as 94. Stuffing box hub 90 is flanged at the other end and mounted to the grinding chamber at bolts such as 96. A lantern ring 98 is interposed in the stack of packing rings and communicates through passage 100 with grease fitting 102, for supplying grease for lubrication. A flushing fitting 104 supplies flushing water through passage 106 to annular plenum chamber 108 in hub 90 to supply flushing water along annular gap 110 between the hub and sleeve 84 on shaft 74 to flush debris such as clinker slurry or particles back into grinding chamber 66 for discharge through chute 75.

FIGS. 5–9 show improved structure in accordance with the present invention, and use like reference numerals from above where appropriate to facilitate understanding. Stuffing box assembly 120 in FIG. 5 has a flushing fitting 104 for supplying flushing fluid into chamber 108 and gap 110 along sleeve 84 on shaft 74 and into grinding chamber 66, as in FIG. 4. A one-way valve and seal 122 is provided, permitting flushing fluid flow from the flushing fitting into the grinding chamber, as shown in FIG. 6 at arrow 124, and blocking reverse flow, FIG. 5. Seal 122 is preferably provided by an annular rubber disc 126, preferably gum rubber, having an inner lip 128 along its inner circumference and through which shaft 74 extends. Annular disc 126 is resiliently flexible along inner lip 128 and flexes to an open position FIG. 6, and separates from the shaft, as shown at gap 130, in response to flushing fluid flowing along shaft 74 from flushing fitting 104, and permitting such flushing fluid to flow along the shaft past lip 128 and into grinding chamber 66. Annual rubber disc 126 flexes back to a closed position, FIG. 5, engaging shaft 74 in response to attempted reverse flow, namely right to left in FIG. 5, of flushing fluid from the grinding chamber, to block return flow of fluid along shaft 74 past lip 128 from the grinding chamber, and to prevent clinker debris from entering the stuffing box while the grinder is shut down.

Stuffing box assembly 120 has distally opposite inner and outer axial end faces 132 and 134. Annular disc 126 is mounted to inner axial end face 132 co-axially with shaft 74 and axially facing grinding chamber 66. Inner lip 128 in the open position, FIG. 6, is flexed axially away from inner axial end face 134. Also in the noted open position, FIG. 6, inner lip 128 is flexed radially away from shaft 74, to define annular gap 130 therebetween. An annular stainless steel retainer 136 has an inner diameter 138 greater than the inner diameter of annular disc 126 at inner lip 128. Retainer 136 is mounted to inner axial end face 132 of stuffing box hub 90 by a plurality of bolts 140, preferably having allen head sockets 142, FIG. 8, and holding annular disc 126 against inner axial end face 132. Annular disc 126 is between retainer 136 and inner axial end face 132.

Annular plenum chamber 108 is axially spaced between the packing rings and inner axial end face 132 and receives flushing fluid from flushing fitting 104. Because of the seal provided by member 126, grease fitting 102 and lantern ring 98 may be eliminated, and grease passage 100 is plugged off by plug 144. Instead of lantern ring 98, an additional packing ring 146 is provided. Furthermore, sleeve 84 is hardened on its outer surface at tungsten carbide layer 148, FIG. 9. These modifications in combination, particularly the sealing provided by seal 122, enable the noted elimination of grease fitting 102 and lantern ring 98. In the prior art, fine clinker particles could migrate right to left in FIG. 4 and get into the packing rings which shortened life and caused leakage. The grease provided at fitting 102 was needed to lubricate the shaft and packing rings and extend life and fight migration of clinker particles along the shaft. The present combination has been found to provide long life and substantially reduce the noted leakage problem without the need for grease fitting 102. Packing rings 85–89 and 146 are preferably Kevlar.

In a desirable further embodiment, stuffing box assembly 120 is preloaded by one or more belleville washers 150 between packing gland 92 and the mounting bolt heads such as 94. This preloaded packing adjustment eliminates or reduces packing adjustment during extended periods of clinker grinding by providing continual packing bias.

It is recognized that various equivalents, alternatives and modifications are possible within the scope of the appended claims.

What is claimed is:

1. In a coal-burning utility electrical power generation plant having a mill pulverizing coal and supplying same to a boiler for combustion, the boiler having a bottom ash hopper for receiving combustion products including clinkers, and a clinker grinder for grinding said clinkers, said clinker grinder comprising a rotary drum in a grinding chamber and having grinding teeth and driven by a rotary shaft extending through a stuffing box assembly, said stuffing box assembly having a flushing fitting for supplying flushing fluid thereto and along said shaft and into said grinding chamber, a seal permitting flushing fluid flow from said flushing fitting into said grinding chamber and blocking reverse flow, wherein said stuffing box assembly has a hub receiving a plurality of coaxially aligned packing rings, and comprising a biasing member applying continuing packing bias against said rings.

2. The invention according to claim 1 wherein said stuffing box assembly includes a packing gland retaining said packing rings in said hub and a plurality of mounting bolts mounting said packing gland to said hub, and wherein said biasing member applies said continual packing bias against said packing gland.

3. The invention according to claim 2 wherein said biasing member comprises a belleville washer bearing between said bolt and said packing gland.

4. A coal-burning utility electrical power generation plant comprising a mill pulverizing coal and supplying same to a boiler for combustion, said boiler having a bottom ash hopper for receiving combustion products including clinkers, and a clinker grinder for grinding said clinkers, said clinker grinder comprising a rotary drum in a grinding chamber and having grinding teeth and driven by a rotary shaft extending through a stuffing box assembly, said stuffing box assembly having a flushing fitting for supplying flushing fluid thereto and along said shaft and into said grinding chamber, an annular disc having an inner lip along its inner circumference and through which said shaft extends, said annular disc being resiliently flexible along said inner lip and flexing to an open position and separating from said shaft in response to flushing fluid flowing along said shaft from said flushing fitting and permitting said flushing fluid to flow along said shaft past said inner lip and into said grinding chamber, and flexing back to a closed position engaging said shaft in response to attempted reverse flow of flushing fluid from said grinding chamber to block return flow of flushing fluid along said shaft past said lip from said grinding chamber, wherein said stuffing box assembly has a hub with distally opposite inner and outer axial end faces, said annular disc is mounted to said inner axial end face co-axially with said shaft and facing said grinding chamber, wherein said inner lip in said open position is flexed axially away from said inner axial end face, and is flexed radially away from said shaft to define an annular gap therebetween, and comprising an annular retainer having an inner diameter greater than the inner diameter of said annual disc at said inner lip, said retainer being mounted to said inner axial end face and holding said annular disc thereagainst, said annular disc being between said retainer and said inner axial end face.

5. In a coal-burning utility electrical power generation plant having a mill pulverizing coal and supplying same to a boiler for combustion, the boiler having a bottom ash hopper for receiving combustion products including clinkers, and a clinker grinder for grinding said clinkers, said clinker grinder comprising a rotary drum in a grinding chamber and having grinding teeth and driven by a rotary shaft extending through a stuffing box assembly, said stuffing box assembly having a flushing fitting for supplying flushing fluid thereto and along said shaft and into said grinding chamber, a seal permitting flushing fluid flow from said flushing fitting into said grinding chamber and blocking reverse flow, wherein said seal comprises an annular disc having an inner lip along its inner circumference and through which said shaft extends, said annular disc being resiliently flexible along said inner lip and flexing to an open position and separating from said shaft in response to flushing fluid flowing along said shaft from said flushing fitting, and permitting said flushing fluid to flow along said shaft past said lip and into said grinding chamber, and flexing back to a closed position engaging said shaft in response to attempted reverse flow of flushing fluid from said grinding chamber to block return flow of fluid along said shaft past said lip from said grinding chamber, said stuffing box assembly has a hub with distally opposite inner and outer axial end faces, and wherein said annular disc is mounted to said inner axial end face co-axially with said shaft and axially facing said grinding chamber, and wherein said inner lip in said open position is flexed axially away from said inner axial end face, said inner lip in said open position is flexed radially away from said shaft to define an annular gap therebetween, said stuffing box assembly has a plurality of co-axially aligned packing rings between said axial end faces and receiving said shaft extending therethrough.

6. The invention according to claim 5 comprising a sleeve around said shaft extending through said stuffing box assembly and engaged by said packing rings, said sleeve having a hardened outer surface.

7. The invention according to claim 5 wherein said stuffing box assembly has an annular plenum chamber axially spaced between said packing rings and said inner axial end face and receiving flushing fluid from said flushing fitting, wherein said shaft rotates in said stuffing box assembly without a grease fitting supplying grease to the latter.

8. In a coal-burning utility electrical power generation plant having a mill pulverizing coal and supplying same to a boiler for combustion, the boiler having a bottom ash hopper for receiving combustion products including clinkers, and a clinker grinder for grinding said clinkers, said clinker grinder comprising a rotary drum in a grinding chamber and having grinding teeth and driven by a rotary shaft extending through a stuffing box assembly, said stuffing box assembly having a flushing fitting for supplying flushing fluid thereto and along said shaft and into said grinding chamber, a seal permitting flushing fluid flow from said flushing fitting into said grinding chamber and blocking reverse flow, wherein said seal comprises an annular disc having an inner lip along its inner circumference and through which said shaft extends, said annular disc being resiliently flexible along said inner lip and flexing to an open position and separating from said shaft in response to flushing fluid flowing along said shaft from said flushing fitting, and permitting said flushing fluid to flow along said shaft past said lip and into said grinding chamber, and flexing back to a closed position engaging said shaft in response to attempted reverse flow of flushing fluid from said grinding chamber to block return flow of fluid along said shaft past said lip from said grinding chamber, said stuffing box assembly has a hub with distally opposite inner and outer axial end faces, and wherein said annular disc is mounted to said inner axial end face co-axially with said shaft and axially facing said grinding chamber, and wherein said inner lip in said open position is flexed axially away from said inner axial end face, said inner lip in said open position is flexed radially away from said shaft to define an annular gap therebetween, and comprising an annular retainer having an inner diameter greater than the inner diameter of said annular disc at said inner lip, said retainer being mounted to said inner axial end face and holding said annular disc thereagainst, said annular disc being between said retainer and said inner axial end face.

9. The invention according to claim 8 wherein said retainer is stainless steel.

* * * * *